US010344727B2

(12) United States Patent
Takahashi et al.

(10) Patent No.: US 10,344,727 B2
(45) Date of Patent: Jul. 9, 2019

(54) ELECTROMAGNETIC FUEL INJECTION VALVE FOR IN-CYLINDER INJECTION

(71) Applicant: KEIHIN CORPORATION, Shinjuku-Ku, Tokyo (JP)

(72) Inventors: Michihiro Takahashi, Kakuda (JP); Hironori Hashimoto, Kakuda (JP)

(73) Assignee: Kelhin Corporation, Tokyo (JP)

( * ) Notice: Subject to any disclaimer, the term of this patent is extended or adjusted under 35 U.S.C. 154(b) by 0 days.

(21) Appl. No.: 15/416,199

(22) Filed: Jan. 26, 2017

(65) Prior Publication Data

US 2017/0260951 A1 Sep. 14, 2017

(30) Foreign Application Priority Data

Mar. 10, 2016 (JP) ..... 2016-047124
Mar. 10, 2016 (JP) ..... 2016-047125

(51) Int. Cl.
*F02M 51/06* (2006.01)
*F02M 61/18* (2006.01)

(52) U.S. Cl.
CPC ..... *F02M 61/184* (2013.01); *F02M 51/061* (2013.01); *F02M 61/1806* (2013.01); *F02M 61/1886* (2013.01); *F02M 51/0685* (2013.01)

(58) Field of Classification Search
CPC ..... F02M 61/184; F02M 61/1886; F02M 61/1833; F02M 61/1853; F02M 61/186; F02M 61/1806; F02M 61/1846; F02M 51/061; F02M 51/0671
See application file for complete search history.

(56) References Cited

U.S. PATENT DOCUMENTS 7,128,282 B2 * 10/2006 Okamoto ..... F02M 51/0671 239/596
2013/0099015 A1 * 4/2013 Sumida ..... F02M 61/184 239/1
2015/0021416 A1 * 1/2015 Raney ..... H05K 999/00 239/558
2016/0356253 A1 * 12/2016 Noguchi ..... F02M 61/184

FOREIGN PATENT DOCUMENTS

| | | | |
|---|---|---|---|
| FR | 2860557 | A1 | 4/2005 |
| JP | S59-43673 | U | 3/1984 |
| JP | H08-218986 | A | 8/1996 |
| JP | 2004-332543 | A | 11/2004 |
| JP | 2005-139989 | A | 6/2005 |
| JP | 2009-236057 | A | 10/2009 |
| JP | 2011-190801 | A | 9/2011 |

OTHER PUBLICATIONS

Official Communication issued over the corresponding Japanese Patent Application 2016-047124 dated Apr. 12, 2017.

* cited by examiner

*Primary Examiner* — George C Jin
(74) *Attorney, Agent, or Firm* — Carrier Blakman & Associates, P.C.; Joseph P. Carrier; Jeffrey T. Gedeon

(57) ABSTRACT

In an electromagnetic fuel injection valve for in-cylinder injection, a fuel injection hole is an elongated hole having a major axis and a minor axis, the major axis being curved into an arc shape having a radius that is smaller than a radius of a pitch circle of an inlet of the fuel injection hole. Accordingly, the electromagnetic fuel injection valve can ensure a required flow rate even when a penetrating power is decreased.

4 Claims, 5 Drawing Sheets

ELECTROMAGNETIC FUEL INJECTION VALVE FOR IN-CYLINDER INJECTION

BACKGROUND OF THE INVENTION

Field of the Invention

The present invention relates to an electromagnetic fuel injection valve for in-cylinder injection mainly used for a fuel supply system of an internal combustion engine, particularly, relates to an improvement of the electromagnetic fuel injection valve for in-cylinder injection including a valve seat member that has a valve seat and a plurality of fuel injection holes arranged in a ring shape and that injects fuel through the fuel injection holes, and a valve body that opens and closes the fuel injection holes in cooperation with the valve seat.

Description of the Related Art

Such an electromagnetic fuel injection valve for in-cylinder injection is known as disclosed in Japanese Patent Application Laid-open No. 2005-139989.

In the electromagnetic fuel injection valve for in-cylinder injection described in Japanese Patent Application Laid-open No. 2005-139989 described above, one injector is provided with a first injection hole forming a first angle and a second injection hole forming a second angle that is larger than the first angle and having a smaller penetrating power than that of the first injection hole, at a time of stratified combustion spray from the first injection hole is concentrated around a spark plug via a cavity, on the other hand at a time of diffusion combustion spray from the second injection hole is diffused through the whole of a combustion chamber, thus achieving both stratification of an air-fuel mixture at a time of stratified combustion and homogenization of the air-fuel mixture at a time of diffusion combustion.

In this arrangement, in order to make the penetrating power of the second injection hole smaller than the penetrating power of the first injection hole, the hole diameter of the injection hole is decreased, but when the hole diameter of the injection hole is decreased the flow rate reduces, it becomes difficult to ensure a flow rate of a certain degree or higher while decreasing the penetrating power, and there is a possibility that a situation that does not suit the actual situation in recent years where various combustion modes and spraying modes are required will occur.

SUMMARY OF THE INVENTION

The present invention has been accomplished in light of such circumstances, and it is an object thereof to provide an electromagnetic fuel injection valve for in-cylinder injection that can ensure a required flow rate even when a penetrating power is decreased.

In order to achieve the object, according to a first aspect of the present invention, there is provided an electromagnetic fuel injection valve for in-cylinder injection comprising a valve seat member that has a valve seat and a plurality of fuel injection holes arranged in a ring shape and that injects fuel through the fuel injection holes, and a valve body that opens and closes the fuel injection holes in cooperation with the valve seat, wherein the fuel injection hole is an elongated hole having a major axis and a minor axis, the major axis being curved into an arc shape having a radius that is smaller than a radius of a pitch circle of an inlet of the fuel injection hole.

In accordance with the first aspect of the present invention, since the fuel injection hole is an elongated hole having the major axis and the minor axis, the major axis is curved into an arc shape, and the radius of the major axis is smaller than the radius of the pitch circle of the inlet of the fuel injection hole, an inner peripheral wall of the fuel injection hole also curves with a radius smaller than the radius of the pitch circle. Because of this, fuel that is injected moves along the curved inner peripheral wall of the fuel injection hole, turbulence is generated so that it swirls in the interior of the fuel injection hole, and the penetrating power is therefore decreased by means of the generated turbulence. Since this decrease in the penetrating power is not achieved by reducing the diameter of the fuel injection hole but by changing the shape of the fuel injection hole, even if the flow rate is ensured by increasing the dimensions of the major axis and the minor axis, it becomes possible to decrease the penetrating power by means of the generated turbulence.

According to a second aspect of the present invention, in addition to the first aspect, the fuel injection hole is formed from a large diameter wall having a radius that is larger than the radius of the major axis, a small diameter wall having a radius that is smaller than the radius of the major axis, and a connecting wall that connects the large diameter wall and the small diameter wall.

In accordance with the second aspect of the present invention, since the fuel injection hole is formed from the large diameter wall having a radius larger than the radius of the major axis, the small diameter wall having a radius smaller than the radius of the major axis, and the connecting wall connecting the large diameter wall and the small diameter wall, it becomes easy for fuel to enter the fuel injection hole from the large diameter wall side where the curvature is small, and it becomes difficult for fuel to enter it from the small diameter wall side where the curvature is large. Because of this, flows of fuel having different movements collide with each other within the fuel injection hole, thus enabling greater turbulence to be generated and thereby further decreasing the penetrating power.

According to a third aspect of the present invention, in addition to the second aspect, an imaginary circle forming the large diameter wall and an imaginary circle forming the small diameter wall have an identical center.

In accordance with the third aspect of the present invention, since the imaginary circle forming the large diameter wall and the imaginary circle forming the small diameter wall have the identical center, the length of the minor axis is constant in the peripheral direction of the fuel injection hole and it becomes easy to control the injection flow rate.

According to a fourth aspect of the present invention, in addition to the first aspect, at least some of the fuel injection holes have one of two intersection points of the major axis and an inner peripheral wall of the some fuel injection holes present on a radially outer side of the pitch circle.

In accordance with the fourth aspect of the present invention, since one of the two intersection points of the inner peripheral wall and the major axis in at least some of the fuel injection holes is present on the radially outer side of the pitch circle, even if there is a portion of the valve seat member where fuel easily becomes detached from the wall face of the fuel injection hole due to the distance from the center of the valve seat member to the fuel injection hole, the inclination angle of the fuel injection hole with respect to the valve seat member, etc., because at least some of the fuel injection holes extends on both the radially outer side and inner side of the pitch circle, it is possible to limit the place where there is detachment to part of the fuel injection hole, thus suppressing variation in the amount of detachment. Furthermore, since the injection hole dimensions toward the radially outer side of the pitch circle can be ensured, it is possible to promote the movement of fuel to the outside.

According to a fifth aspect of the present invention, in addition to the fourth aspect, all of the fuel injection holes have one of the intersection points present on the radially outer side of the pitch circle.

In accordance with the fifth aspect of the present invention, since in all of the fuel injection holes, one of the intersection points of the inner peripheral wall and the major axis of the fuel injection hole and is present on the radially outer side of the pitch circle, it is possible to suppress variation in the amount of fuel detachment more effectively. Moreover, when the fuel injection hole is formed by laser machining, when the inclination angle of the fuel injection hole with respect to the valve seat member is directed outward, in order to avoid interference between a laser beam and the cylindrical portion of the valve seat member, it is necessary to place an interference-preventing member on an inner face of the cylindrical portion of the valve seat member, but since the injection hole dimensions toward the radially outer side of the pitch circle can be ensured, and the movement of fuel to the outside can be promoted effectively, it becomes possible to inject fuel to the outer side without directing the angle of inclination of the fuel injection hole with respect to the valve seat member outward, and it is possible to make it difficult for interference between the laser beam and the cylindrical portion of the valve seat member to occur, thus making it possible to omit an interference-preventing member.

According to a sixth aspect of the present invention, in addition to the fifth aspect, all of the fuel injection holes have the minor axis inclined toward a same side with respect to a straight line extending in a radial direction from a center of the pitch circle.

In accordance with the sixth aspect of the present invention, since the minor axes of all of the fuel injection holes are inclined toward the same side with respect to a straight line extending in the radial direction from the center of the pitch circle, it is possible to easily make the injection flow rate and the spray length uniform, thus making control of the injection flow rate easy.

According to a seventh aspect of the present invention, in addition to the first aspect, the inlets of all of the fuel injection holes are disposed on the single pitch circle.

In accordance with the seventh aspect of the present invention, since the inlets of all of fuel injection holes are disposed on the single pitch circle, it is possible to make the penetrating power and the injection flow rate of fuel injected from each of the fuel injection holes uniform.

The above and other objects, characteristics and advantages of the present invention will be clear from detailed descriptions of the preferred embodiments which will be provided below while referring to the attached drawings.

DESCRIPTION OF THE PREFERRED EMBODIMENTS

Embodiments of the present invention will be explained based of the attached drawings.

First Embodiment

Figure 1:
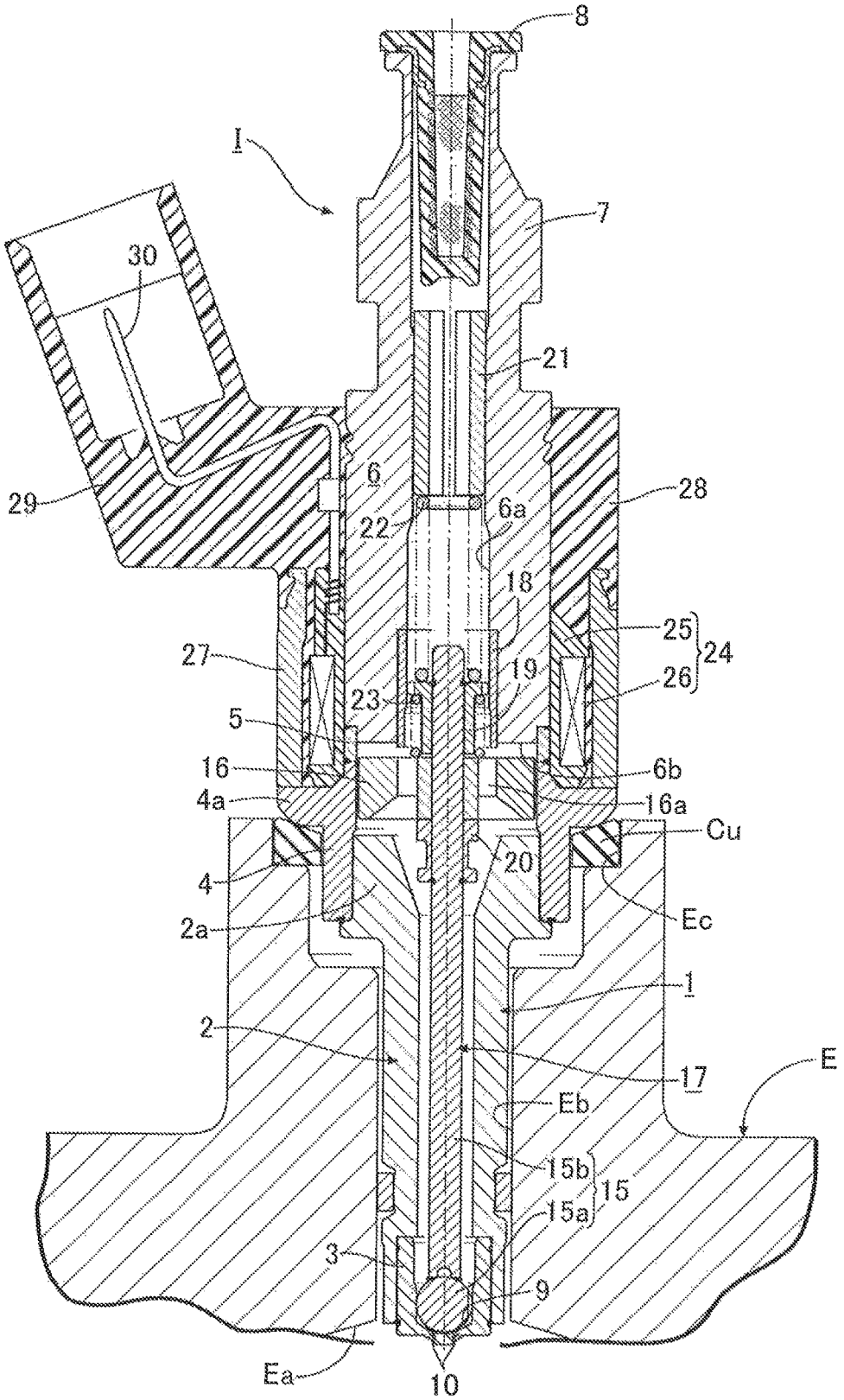
FIG. 1 is a longitudinal sectional side view of an electromagnetic fuel injection valve for in-cylinder injection according to first and second embodiments of the present invention.
Figure 2:
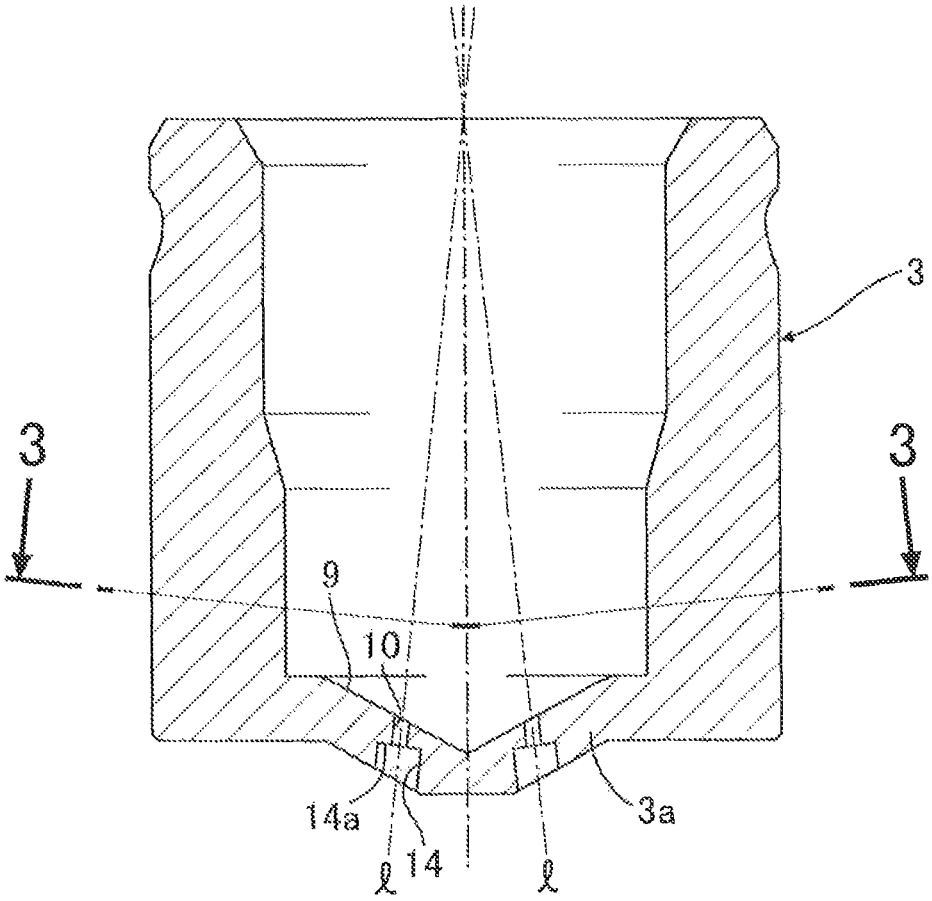
FIG. 2 is an enlarged sectional view of a valve seat member in FIG. 1 (first embodiment).
Figure 3:
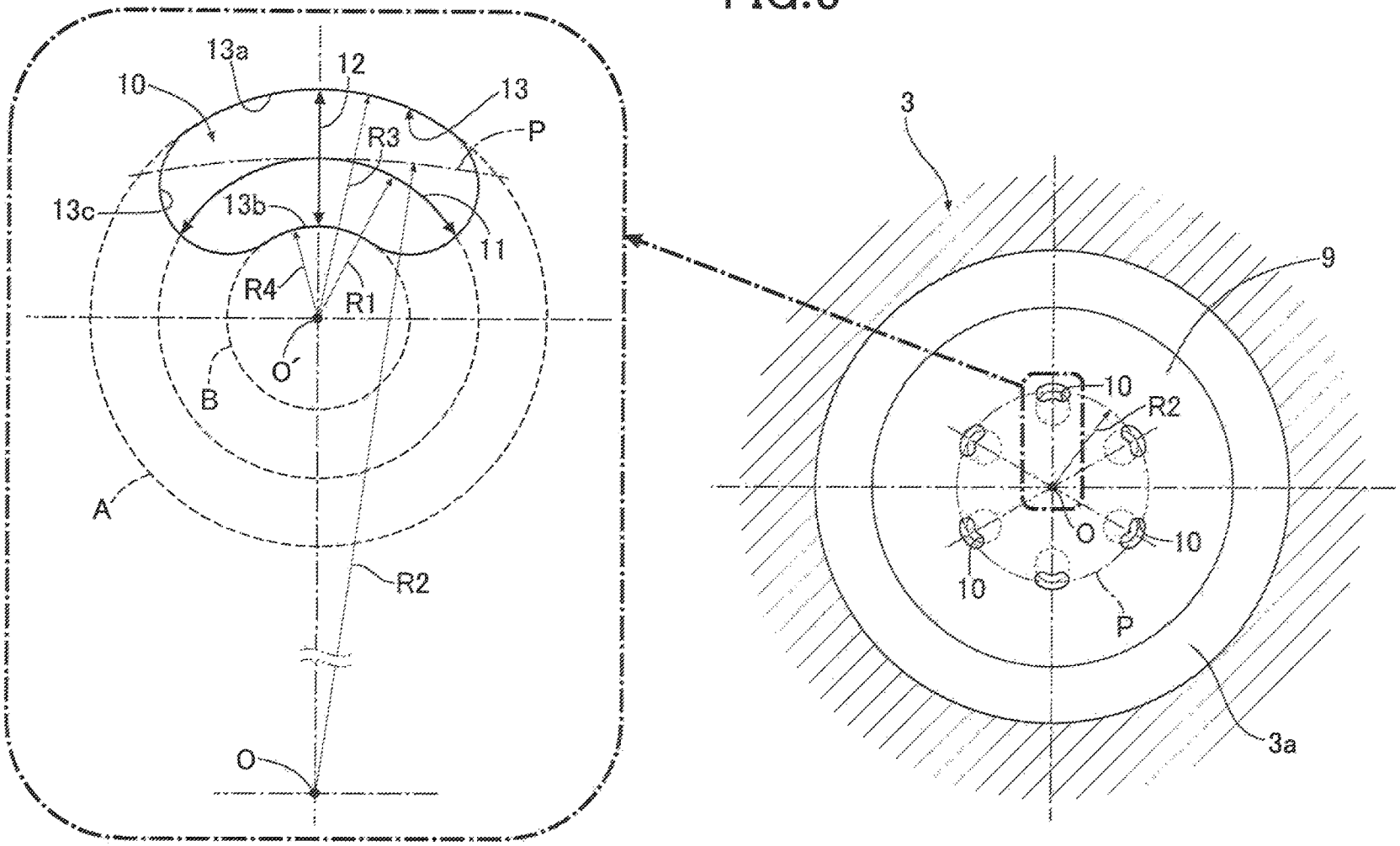
FIG. 3 is a view from arrowed line 3-3 in FIG. 2 (first embodiment).

First of all, a first embodiment of the present invention is explained based on FIG. 1 to FIG. 3.

In FIG. 1, a fitting hole Eb opening in a combustion chamber Ea is provided in an engine cylinder head E, and an electromagnetic fuel injection valve I for in-cylinder injection is fitted into the fitting hole Eb. This fuel injection valve I can inject fuel toward the combustion chamber Ea. In the fuel injection valve I, the side on which fuel is injected is defined as the front, and the side on which fuel flows in is defined as the rear.

A valve housing 1 of the fuel injection valve I is formed from a hollow cylindrical valve housing body 2, a bottomed cylindrical valve seat member 3 fitted into and welded to an inner peripheral face of a front end part of the valve housing body 2, a magnetic cylindrical body 4 fitted onto and welded to the outer periphery of a large diameter portion 2*a* at the rear end of the valve housing body 2, and a non-magnetic cylindrical body 5 coaxially joined to the rear end of the magnetic cylindrical body 4. A fixed core 6 is coaxially joined to the rear end of the non-magnetic cylindrical body 5, and a fuel inlet tube 7 is coaxially and integrally connected to the rear end of the fixed core 6. The fixed core 6 has a hollow portion 6*a* communicating with the interior of the fuel inlet tube 7.

The magnetic cylindrical body 4 integrally has a flange-shaped yoke portion 4*a* on an intermediate part in the axial direction, this yoke portion 4*a* is supported via a cushion member Cu by a load-receiving hole Ec surrounding an opening at the upper end of the fitting hole Eb of the cylinder head E, and a fuel filter 8 is fitted into an inlet of the fuel inlet tube 7.

Referring in addition to FIG. 2 and FIG. 3, the bottomed cylindrical valve seat member 3 has a conical valve seat 9 on a front end wall 3*a* and a plurality of fuel injection holes 10 arranged in a ring shape and opening in the vicinity of the center of the valve seat 9.

The fuel injection hole 10 is an elongated hole having a major axis 11 and a minor axis 12, and the major axis 11 is curved into an arc shape. Furthermore, inlets of the fuel injection holes 10 are disposed on one pitch circle P at equal intervals, and a radius R1 of the major axis 11 is smaller than a radius R2 of the pitch circle P. In addition, the inlets of the fuel injection holes 10 may be disposed separately on a plurality of pitch circles P, and the intervals may be unequal.

The minor axis 12 of the fuel injection hole 10 is disposed along a straight line extending in the radial direction from a center O of the pitch circle P, and the major axis 11 of the fuel injection hole 10 and the pitch circle P are in contact with each other at a center position of the fuel injection hole 10.

An inner peripheral wall 13 of the fuel injection hole 10 is formed from a large diameter wall 13*a* having a radius R3 that is larger than the radius R1 of the major axis 11, a small diameter wall 13*b* having a radius R4 that is smaller than the radius R1 of the major axis 11, and a connecting wall 13*c* connecting the large diameter wall 13*a* and the small diameter wall 13*b*. An imaginary circle A forming the large diameter wall 13*a* and an imaginary circle B forming the small diameter wall 13*b* have an identical center O', but the centers of these circles A and B may be present at different positions.

A recess part 14 having a bottom 14*a* orthogonal to an axis f of the fuel injection hole 10 is formed in the front end wall 3*a* of the valve seat member 3 from the front side, and a downstream end of the fuel injection hole 10 opens on the bottom 14*a* of the recess part 14.

A valve assembly 17 formed from a valve body 15 and a movable core 16 is housed within the valve housing 1 from the valve seat member 3 to the non-magnetic cylindrical body 5. The valve body 15 is formed from a spherical valve portion 15*a* that opens and closes the fuel injection hole 10 in cooperation with the valve seat 9 and a valve rod 15*b* that supports the valve portion 15*a* and extends to the hollow portion 6*a* of the fixed core 6. The valve portion 15*a* is formed into a spherical shape so that it is slidably supported on an inner peripheral face of the valve seat member 3, and a plurality of flat parts that enable fuel to flow are provided on the outer peripheral face of the valve portion 15*a*. Furthermore, a fuel passage 16*a* in which fuel flows is also provided in an intermediate part in the radial direction of the movable core 16.

A cylindrical guide bush 18 is press fitted into an inner peripheral face of the fixed core 6. In this arrangement, the guide bush 18 is disposed so that its front end part projects slightly from a front end face of the fixed core 6, that is, an attracting face 6*b*.

A sliding member 19 slidably fitted into an inner peripheral face of the guide bush 18 and a stopper member 20 disposed between the movable core 16 and the valve portion 15*a* are fixedly provided by welding, etc. on the valve rod 15*b*, the sliding member 19 being disposed so that its lower end face projects from a lower end face of the guide bush 18 at a valve-closed position of the valve body 15. The movable core 16, which is disposed so as to oppose the attracting face 6*b* of the fixed core 6, is slidably fitted around the valve rod 15*b* so that it can move within a limited stroke between the sliding member 19 and the stopper member 20.

The guide bush 18 and the sliding member 19 are formed from a non-magnetic or weakly magnetic material having a hardness that is higher than that of the fixed core 6, for example martensitic stainless steel. Therefore, the hardness of the guide bush 18 and the hardness of the sliding member 19 are made substantially equal.

A pipe-shaped retainer 21 is fitted by being inserted into the hollow portion 6*a* of the fixed core 6 and fixed thereto by swaging, and a valve spring 22 is provided in a compressed state between the retainer 21 and the sliding member 19, the valve spring 22 urging the valve body 15 in a direction in which it is seated on the valve seat 9, that is, in the valve-closing direction. In this arrangement, a set load of the valve spring 22 is adjusted by the length via which the retainer 21 is fittingly inserted into the fixed core 6. Since as described above the sliding member 19 has a higher hardness than that of the fixed core 6, a location that functions as a spring seat for the valve spring 22 has high abrasion resistance.

Furthermore, an auxiliary spring 23 is provided in a compressed state between the sliding member 19 and the movable core 16, this auxiliary spring 23 acting so as to separate the sliding member 19 from the movable core 16 with a set load that is smaller than the set load of the valve spring 22.

A rear end part of the valve rod 15*b* projects from a rear end face of the sliding member 19 and is fitted into an inner peripheral face of a movable end part of the valve spring 22, thus playing a role in its positioning, and the sliding member 19 is fitted into an inner peripheral face of the auxiliary spring 23, thus playing a role in its positioning. Furthermore, a plurality of cutouts as fuel flow paths are provided in the outer periphery of the sliding member 19.

A coil assembly 24 is fitted around an outer peripheral face from the rear end part of the magnetic cylindrical body 4 to the fixed core 6. This coil assembly 24 is formed from a bobbin 25 fitted around the outer peripheral face and a coil 26 wound around the bobbin 25, and a front end part of a coil housing 27 housing the coil assembly 24 is placed on the yoke 4*a* of the magnetic cylindrical body 4 and welded thereto.

A synthetic resin covering layer 28 is molded so as to cover outer peripheral faces from a rear end part of the coil housing 27 to a rear end part of the fixed core 6. A coupler 29 protruding toward one side of the fixed core 6 is connectedly provided integrally with the covering layer 28, and a terminal 30 connected to the coil 26 is retained by the coupler 29.

The operation of this first embodiment is now explained.

When the coil 26 is in a non-energized state, the valve body 15 is pushed forward by the set load of the valve spring 22 and is seated on the valve seat 9 so as to close the fuel injection hole 10. That is, a valve-closed state is attained, and the movable core 16 maintains a predetermined gap between itself and the front end of the guide bush 18 projecting from the attracting face 6*b* of the fixed core 6.

When the coil 26 is energized, the resulting magnetic flux goes in sequence through the fixed core 6, the coil housing 27, the magnetic cylindrical body 4, and the movable core 16, and the magnetic force first causes the movable core 16 to be attracted to the fixed core 6 and abut against the front end of the sliding member 19 while compressing the auxiliary spring 23. In this process, the movable core 16 abuts against the sliding member 19 while ascending and accelerating against a weak set load of the auxiliary spring 23 to thus quickly push the sliding member 19 up toward the rear against the set load of the valve spring 22, collides with the front end of the guide bush 18, and stops. During this process, the sliding member 19, which has been pushed up toward the rear, is accompanied by the valve rod 15*b*, which is integrated therewith, thus enhancing the valve-opening responsiveness of the valve body 15.

Due to the movable core 16 abutting against the front end of the guide bush 18 while pushing up the sliding member 19, the valve body 15 is retained at a predetermined valve-opening position.

When the valve body 15 opens, high pressure fuel that has been fed under pressure from a fuel distribution pipe, which is not illustrated, to the fuel inlet tube 7 is injected directly from the fuel injection hole 10 into the engine combustion chamber Ea via, in sequence, the interior of the pipe-shaped retainer 21, the hollow portion 6*a* of the fixed core 6, the cutout of the sliding member 19, the fuel passage 16*a* of the movable core 16, the interior of the valve housing 1, and the valve seat 9.

In this arrangement, since the fuel injection hole 10 is an elongated hole having the major axis 11 and the minor axis 12, the major axis 11 is curved into an arc shape, and the radius of the major axis 11 is smaller than the radius of the pitch circle P of the inlet of the fuel injection hole 10, the inner peripheral wall 13 of the fuel injection hole 10 also curves with a radius smaller than the radius of the pitch circle. Because of this, fuel that is injected moves along the curved inner peripheral wall 13 of the fuel injection hole 10, turbulence is generated so that it swirls in the interior of the fuel injection hole 10, and the penetrating power is therefore decreased by means of the generated turbulence. Since this decrease in the penetrating power is not achieved by reducing the diameter of the fuel injection hole 10 but by changing the shape of the fuel injection hole 10, even if the flow rate is ensured by increasing the dimensions of the major axis 11 and the minor axis 12, it becomes possible to decrease the penetrating power by means of the generated turbulence.

In the present embodiment in particular, since the fuel injection hole 10 is formed from the large diameter wall 13*a* having a radius larger than the radius of the major axis 11, the small diameter wall 13*b* having a radius smaller than the radius of the major axis 11, and the connecting wall 13*c* connecting the large diameter wall 13*a* and the small diameter wall 13*b*, it becomes easy for fuel to enter the fuel injection hole 10 from the large diameter wall 13*a* side where the curvature is small, and it becomes difficult for fuel to enter it from the small diameter wall 13*b* side where the curvature is large. Because of this, flows of fuel having different movements collide with each other within the fuel injection hole 10, thus enabling greater turbulence to be generated and thereby further decreasing the penetrating power.

Moreover, since the imaginary circle A forming the large diameter wall 13*a* and the imaginary circle B forming the small diameter wall 13*b* have the identical center O', the length of the minor axis 12 is constant in the peripheral direction of the fuel injection hole 10 and it becomes easy to control the injection flow rate, and since the inlets of the plurality of fuel injection holes 10 are disposed on the single pitch circle P, it is possible to make the penetrating power and the injection flow rate of fuel injected from each of the fuel injection holes 10 uniform.

Furthermore, since the recess part 14 having the bottom 14*a* orthogonal to the axis f of the fuel injection hole 10 is bored in the front end wall 3*a* of the valve seat member 3 from the front, and the downstream end of the fuel injection hole 10 opens on the bottom 14*a* of the recess part 14, it is possible to protect the downstream end of the fuel injection hole 10 from contact with another member.

Second Embodiment

A second embodiment of the present invention is now explained by reference to FIG. 4 and FIG. 5.

Figure 4:
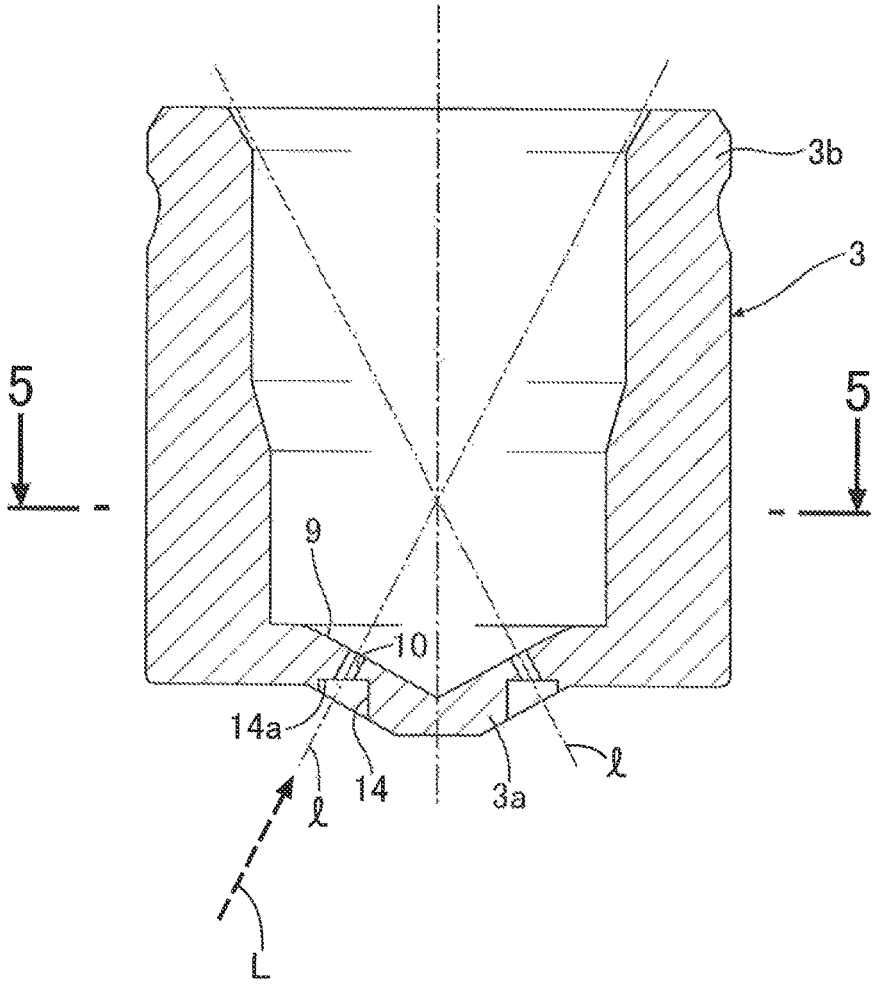
FIG. 4 is an enlarged sectional view of the valve seat member in FIG. 1 (second embodiment).
Figure 5:
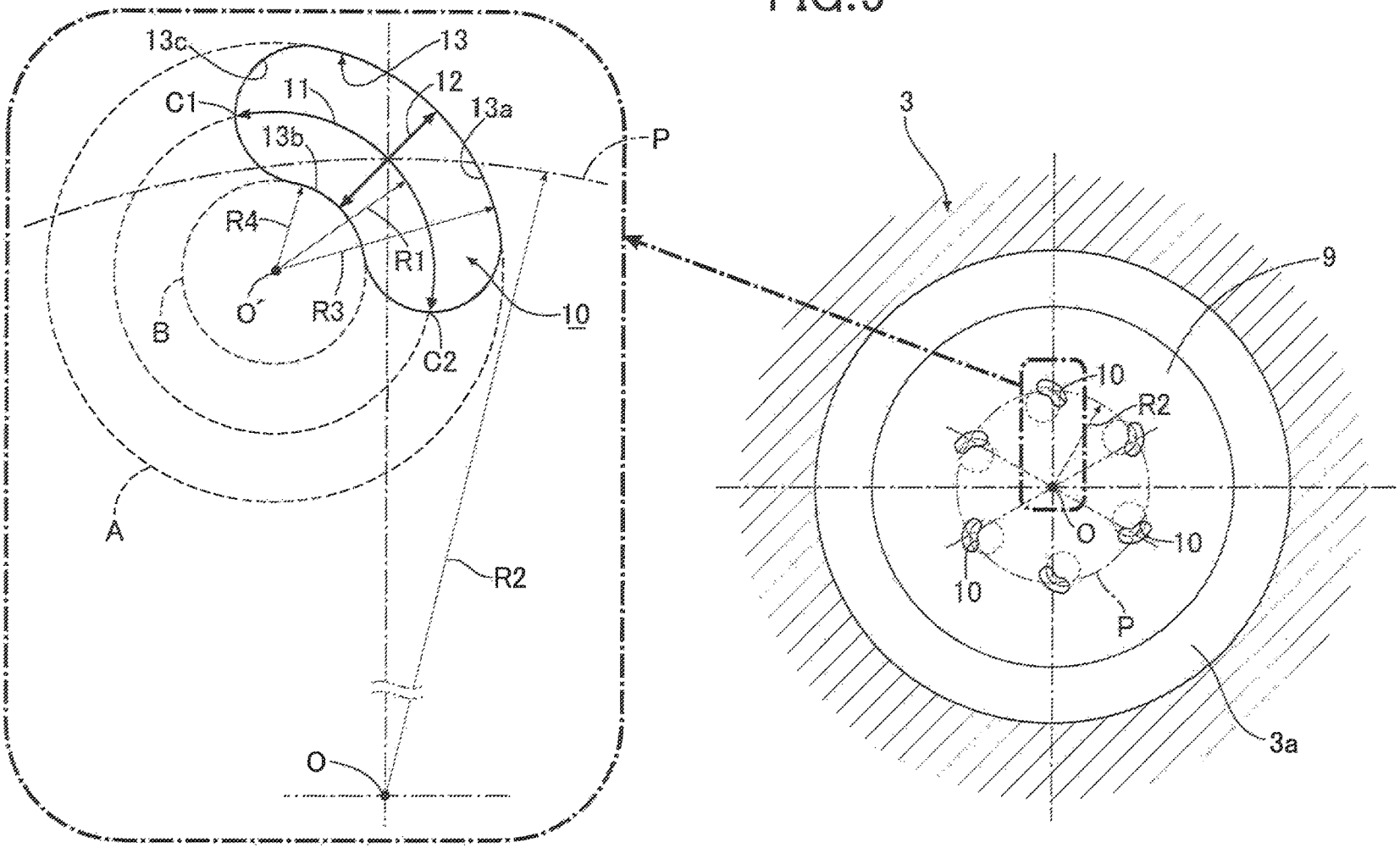
FIG. 5 is a view from arrowed line 5-5 in FIG. 4 (second embodiment).

This second embodiment is different from the first embodiment in terms of one of two intersection points C1 and C2 of the inner peripheral wall 13 and the major axis 11 of at least some of the fuel injection holes 10 (all of the fuel injection holes 10 in the embodiment of FIG. 4 and FIG. 5) being disposed on the radially outer side of the pitch circle P, whereas in the first embodiment both of the intersection points are disposed on the radially inner side of the pitch circle P, but the arrangement is otherwise the same as that of the preceding embodiment; parts in FIG. 4 and FIG. 5 corresponding to those in the preceding embodiment are denoted by the same reference numerals and symbols, and duplication of the explanation is therefore omitted.

In FIG. 4 and FIG. 5, the bottomed cylindrical valve seat member 3 has, on its front end wall 3*a*, the conical valve seat 9 and the plurality of fuel injection holes 10 arranged in a ring shape and opening in the vicinity of the center of the valve seat 9.

The fuel injection hole 10 is an elongated hole having the major axis 11 and the minor axis 12, and the major axis 11 is curved into an arc shape. Furthermore, the inlets of the fuel injection holes 10 are disposed on one pitch circle P at equal intervals, and the radius R1 of the major axis 11 is smaller than the radius R2 of the pitch circle P.

The inner peripheral wall 13 of the fuel injection hole 10 is formed from the large diameter wall 13*a* having the radius R3 that is larger than the radius R1 of the major axis 11, the small diameter wall 13*b* having the radius R4 that is smaller than the radius R1 of the major axis 11, and the connecting wall 13*c* connecting the large diameter wall 13*a* and the small diameter wall 13*b*, and the imaginary circle A forming the large diameter wall 13*a* and the imaginary circle B forming the small diameter wall 13*b* have the identical center O'.

The inlets of the fuel injection holes 10 may be disposed separately on a plurality of pitch circles P, and the intervals may be unequal. Furthermore, the centers of the imaginary circles A and B may be at different positions from each other.

The above arrangement is the same as that of the first embodiment, but in the second embodiment, all of the minor axes 12 of the fuel injection holes 10 are inclined in the same direction with respect to a straight line extending in the radial direction from the center O of the pitch circle P, and one intersection point C1 of the two intersection points C1 and C2 of the inner peripheral wall 13 and the major axis 11 of the fuel injection hole 10 is positioned on the radially outer side of the pitch circle P.

It is not necessary to position all of the intersection points of the fuel injection holes 10 on the radially outer side of the pitch circle P, and it is not necessary to make all of the inclination directions the same either.

The recess part 14 having the bottom 14*a* passing through the axis f of the fuel injection hole 10 is formed in the front end wall 3*a* of the valve seat member 3, the downstream end of the fuel injection hole 10 opening on the bottom 14*a* of the recess part 14. Furthermore, the fuel injection hole 10 is formed at a position where its axis f does not intersect the rear end of a cylindrical portion 3*b* of the valve seat member 3.

The operation of this second embodiment is now explained.

In the second embodiment, since one intersection point C1 of the two intersection points C1 and C2 of the major axis 11 and the inner peripheral wall 13 in at least some of the fuel injection holes 10 (all of the fuel injection holes 10 in the embodiment of FIG. 4 and FIG. 5) is present on the radially outer side of the pitch circle P, even if there is a portion of the valve seat member 3 where fuel easily becomes detached from the wall face of the fuel injection hole 10 due to the distance from the center of the valve seat member 3 to the fuel injection hole 10, the inclination angle of the fuel injection hole 10 with respect to the valve seat member 3, etc., because the fuel injection hole 10 extends on both the radially outer side and inner side of the pitch circle P, it is possible to limit the place where there is detachment to part of the fuel injection hole 10, thus suppressing variation in the amount of detachment. Furthermore, since the injection hole dimensions toward the radially outer side of the pitch circle P can be ensured, it is possible to promote the movement of fuel to the outside.

Moreover, when the fuel injection hole 10 is formed by laser machining, when the inclination angle of the fuel injection hole 10 with respect to the valve seat member 3 is directed outward, in order to avoid interference between a laser beam L and the cylindrical portion 3*b* of the valve seat member 3, it is necessary to place an interference-preventing member on an inner face of the cylindrical portion 3*b* of the valve seat member 3. Disposing one intersection point C1 of the two intersection points C1 and C2 of the major axis 11 and the inner peripheral wall 13 on the radially outer side of the pitch circle P for all of the fuel injection holes 10 enables a portion of the fuel injection hole 10 on the radially outer side of the pitch circle P to be placed at a position away from the center of the valve seat member 3, and it is possible to make it difficult for the axis f of the fuel injection hole 10 to intersect the rear end of the valve seat member 3 as shown in FIG. 4. Moreover, since the injection hole dimensions toward the radially outer side of the pitch circle P can be ensured for all of the fuel injection holes 10, and the movement of fuel to the outside can be promoted effectively, it becomes possible to inject fuel to the outer side without directing the angle of inclination of the fuel injection hole 10 with respect to the valve seat member 3 outward, and it is possible to make it difficult for interference between the laser beam L and the cylindrical portion 3*b* of the valve seat member 3 to occur, thus making it possible to omit an interference-preventing member.

Moreover, since the recess part 14 having the bottom 14*a* with the axis f of the fuel injection hole 10 passing through is bored in the front end wall 3*a* of the valve seat member 3 from the front, and the downstream end of the fuel injection hole 10 opens on the bottom 14*a* of the recess part 14, it is possible to protect the downstream end of the fuel injection hole 10 from contact with another member.

Furthermore, since the minor axes 12 of all of the fuel injection holes 10 are inclined toward the same side with respect to a straight line extending in the radial direction from the center O of the pitch circle P, and the inlets of all of the fuel injection holes 10 are disposed on the single pitch circle P, it is possible to easily make the injection flow rate and the spray length uniform, thus making control of the injection flow rate easy.

The present invention is not limited to the first and second embodiments described above, and may be modified in a variety of ways as long as the modifications do not depart from the gist of the present invention. For example, in the first and second embodiments the movable core 16 can move between the sliding member 19 and the stopper member 20, but this movable core 16 may be fixed to the valve rod 15*b*. Furthermore, it is not particularly necessary to form the recess part 14 in the front end wall 3*a* of the valve seat member 3.

What is claimed is:

1. An electromagnetic fuel injection valve for in-cylinder injection comprising:

a valve seat member that has a valve seat and a plurality of fuel injection holes arranged in a ring shape and that injects fuel through the fuel injection holes, and a valve body that opens and closes the fuel injection holes in cooperation with the valve seat, wherein each of the fuel injection holes is an elongated hole having a major axis and a minor axis, the major axis being curved into an arc shape having a radius that is smaller than a radius of a pitch circle of an inlet of each of the fuel injection holes, each of the fuel injection holes is formed from a large diameter wall having a radius that is larger than the radius of the major axis, a small diameter wall having a radius that is smaller than the radius of the major axis, and connecting walls that connect the large diameter wall and the small diameter wall, and at least some of the fuel injection holes are each arranged such that the major axis intersects with an inner peripheral wall of the fuel injection hole at two intersection points and one of the intersection points is present on a radially outer side of the pitch circle while the other of the intersection points is present on a radially inner side of the pitch circle.

2. The electromagnetic fuel injection valve for in-cylinder injection according to claim 1, wherein a first imaginary circle forming the large diameter wall and a second imaginary circle forming the small diameter wall have an identical center.

3. The electromagnetic fuel injection valve for in-cylinder injection according to claim 1, wherein all of the fuel injection holes have one of the intersection points present on the radially outer side of the pitch circle.

4. The electromagnetic fuel injection valve for in-cylinder injection according to claim 3, wherein all of the fuel injection holes are arranged such that the minor axis is inclined toward a same side with respect to a straight line which extends in a radial direction from a center of the pitch circle and passes an intersection point between the major axis and the minor axis.

* * * * *